US007624613B2

(12) United States Patent
Yu et al.

(10) Patent No.: US 7,624,613 B2
(45) Date of Patent: Dec. 1, 2009

(54) TERMINAL CRIMPING MACHINE

(75) Inventors: Gao-hua Yu, Tu-Cheng (TW); Wei Wang, Tu-Cheng (TW); Xue-jin Li, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 310 days.

(21) Appl. No.: 11/878,005

(22) Filed: Jul. 20, 2007

(65) Prior Publication Data

US 2009/0019912 A1 Jan. 22, 2009

(51) Int. Cl.

| | |
|---|---|
| ***B21D 41/00*** | (2006.01) |
| ***B21D 51/00*** | (2006.01) |
| ***H01R 43/042*** | (2006.01) |
| ***H01R 43/04*** | (2006.01) |

(52) U.S. Cl. ..... 72/402; 72/712; 29/753; 29/861

(58) Field of Classification Search ..... 72/402, 72/420, 421, 446, 448, 481.1, 712; 29/747, 29/748, 753, 754, 761, 857, 861–863
See application file for complete search history.

(56) References Cited

U.S. PATENT DOCUMENTS

| | | | | |
|---|---|---|---|---|
| 5,706,570 | A * | 1/1998 | Inoue et al. | 29/753 |
| 2005/0037677 | A1 * | 2/2005 | Kuwayama et al. | 439/877 |

* cited by examiner

*Primary Examiner*—Dana Ross
*Assistant Examiner*—Teresa M Bonk
(74) *Attorney, Agent, or Firm*—Rosenberg, Klein & Lee

(57) ABSTRACT

A terminal crimping machine includes a frame. An accommodating board is located on the frame and defines recesses unfolding symmetrically. The junction of the recesses defines an aperture running through the accommodating board. Drifts are slidably received in the recesses of the accommodating board respectively. Each of the drifts has a bar which protrudes rearward from a back surface of the drift. A propelled member rotationally configured at the back of the accommodating board defines cavities distributing symmetrically, and each cavity extends continually from outside to inner. The cavities slidably receive the bars of the drifts respectively. A driven mechanism, mounted on the frame, connects with the propelled member.

10 Claims, 6 Drawing Sheets

TERMINAL CRIMPING MACHINE

BACKGROUND OF THE INVENTION

1. Field of the Invention

The present invention relates to a terminal crimping machine for assembling an electric cable to a terminal of a connector.

2. The Related Art

As well known that an electric connector which connects two electronic devices includes an insulating housing and a plurality of terminals. The insulating housing is used for receiving the terminals and isolating the terminals from outside. The terminals are the media for transmitting power or signals. Besides the insulating housing and the terminals, the electric connector should be assembled with an electric cable so as to achieve the power or signals transmission between the two electronic devices. Conventionally, the electric cable is fabricated to the terminals of the electric connector.

One common method of assembling an electric cable to an electric connector is provided with a hand tool which has a pair of handle-operated opposing jaws for movement toward and away from each other at adjacent ends of handle members. One of the jaws has a relatively rigid bearing plate defining a bearing surface facing the opposing jaw for engaging terminals of the electric connector. The other jaw has a stuffer portion or blade for engaging the electric cable and driving the electric cable into a receptacle portion of the terminals. The jaws are closed to assemble the electric cable to the terminals of the electric connector through force exerted by an operator on the handle members. A resiliently yieldable backing member is sandwiched between the bearing plate and the jaw to provide yielding movement therebetween to accommodate variable sized electric connectors positioned between the jaws and to prevent damage to the electric cable due to possible excessive pressure being applied when the electric cable is assembled to the terminals of the electric connector.

Another common method of assembling an electric cable to an electric connector employs a terminal crimping device. The terminal crimping device includes a pressing toothed upper die having a recess, and a lower die which is engaged with the recess to crimp the terminal over the electric cable thereby to connect the terminal to the electric cable. The recess has linear guide walls parallel with each other. So the lower die is slid in the space defined by the linear guide walls, relatively to the pressing toothed upper die.

It can be seen that the two methods of assembling the electric cable to the electric connector described above have different disadvantages. For many instances, the hand tool needs an operator to manipulate, so increasing required manpower, and reducing the assembly efficiency. Even if the aforesaid terminal crimping device increases the assembly efficiency, the force that acts on the terminal to embrace the electric cable is not symmetrical, and then the electrical connection between the electric cable and the terminals is not stable, which brings a bad influence on electrical properties of the electric connector.

SUMMARY OF THE INVENTION

Accordingly, an object of the present invention is to provide a terminal crimping machine for assembling an electric cable to a terminal of a connector. The terminal crimping machine includes a frame. An accommodating board is located on the frame and defines recesses unfolding symmetrically. The junction of the recesses defines an aperture running through the accommodating board. Drifts are slidably received in the recesses of the accommodating board respectively. Each of the drifts has a bar which protrudes rearward from a back surface of the drift. A propelled member rotationally configured at the back of the accommodating board defines cavities distributing symmetrically, and each cavity extends continually from outside to inside. The cavities slidably receive the bars of the drifts respectively. A driven mechanism mounted on the frame, connects with the propelled member.

It can be seen that the design of the terminal crimping machine in accordance with the present invention introduces a propelled member with curving cavities to match with the bars of the drifts which are slidably received in the recesses of the accommodating board. Therefore, the force provided by the driven mechanism acts on the drifts from different directions with the help of the propelled member. That is, the drifts extrude the terminal receiving the electric cable from different directions, making the terminal fixedly embrace the electric cable and assuring electrical properties of the terminal and the electric cable.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
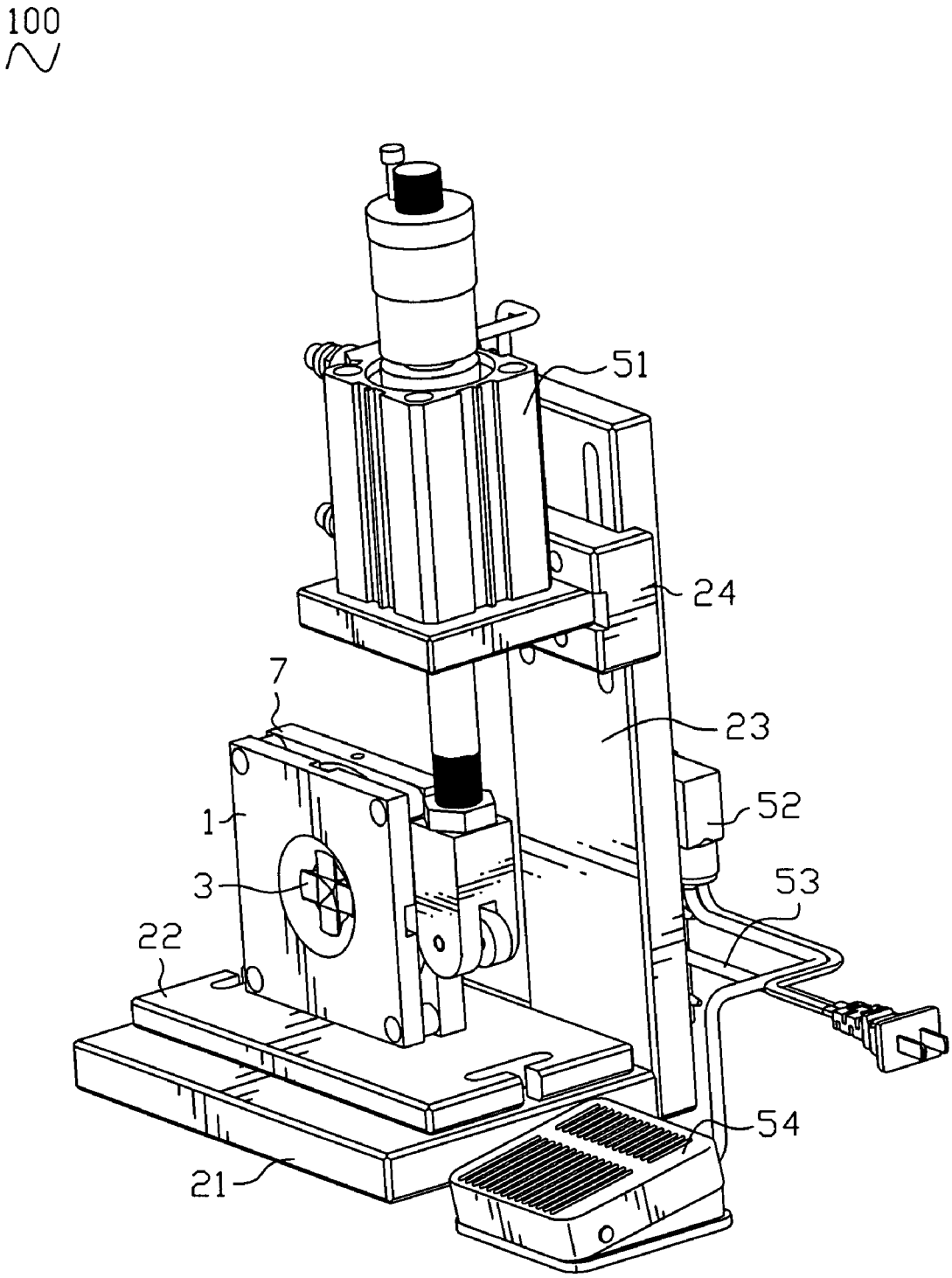
FIG. 1 is a perspective view of a terminal crimping machine in accordance with the present invention.
Figure 2:
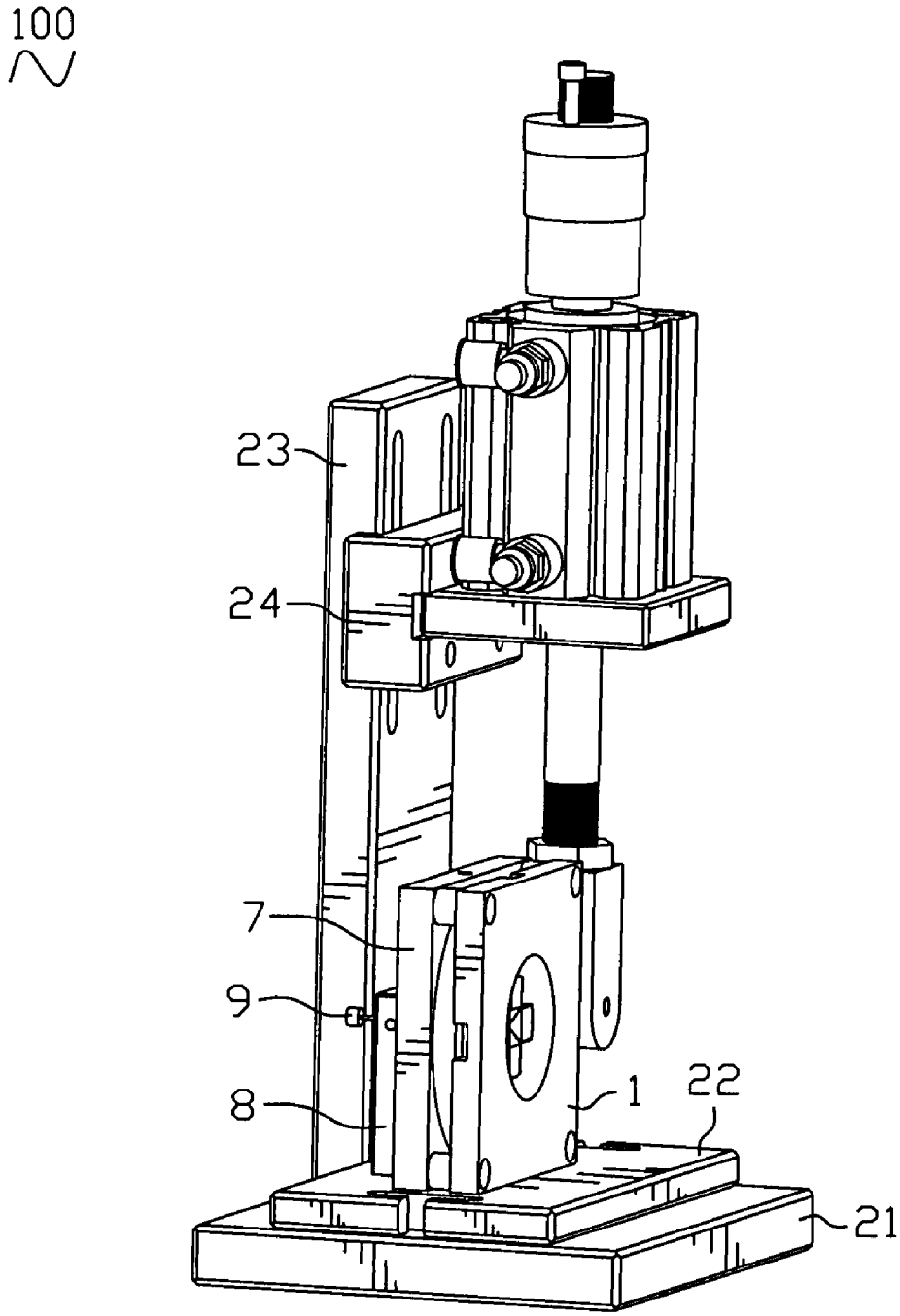
FIG. 2 shows the terminal crimping machine from another angle.

Please refer to FIGS. 1-2 which show a terminal crimping machine 100 from different angles. The terminal crimping machine 100 in accordance with the present invention includes a frame fixedly assembling a crimping mechanism and a driven mechanism.

Figure 4:
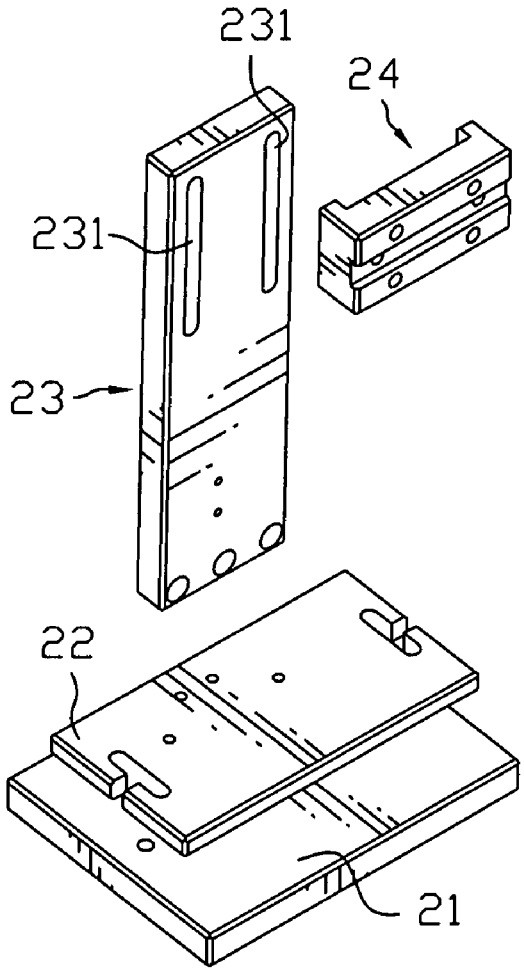
FIG. 4 is an exploded view of a frame of the terminal crimping machine.

With reference to FIG. 1, FIG. 2 and FIG. 4, the frame includes a pedestal 21 in a flat shape. The pedestal 21 engages with a locating board 22 that extends horizontally on top surface thereof. A backside of the pedestal 21 vertically fixedly fabricates a supporting board 23. An upper portion of the supporting board 23 defines a pair of receiving slots 231 extending up and down. A loading member 24 is inserted in the receiving slots 231 to be locked on the supporting board 23. The receiving slots 231 are designed to be a long shape for easily adjusting the loading member 24 up and down.

Figure 3:
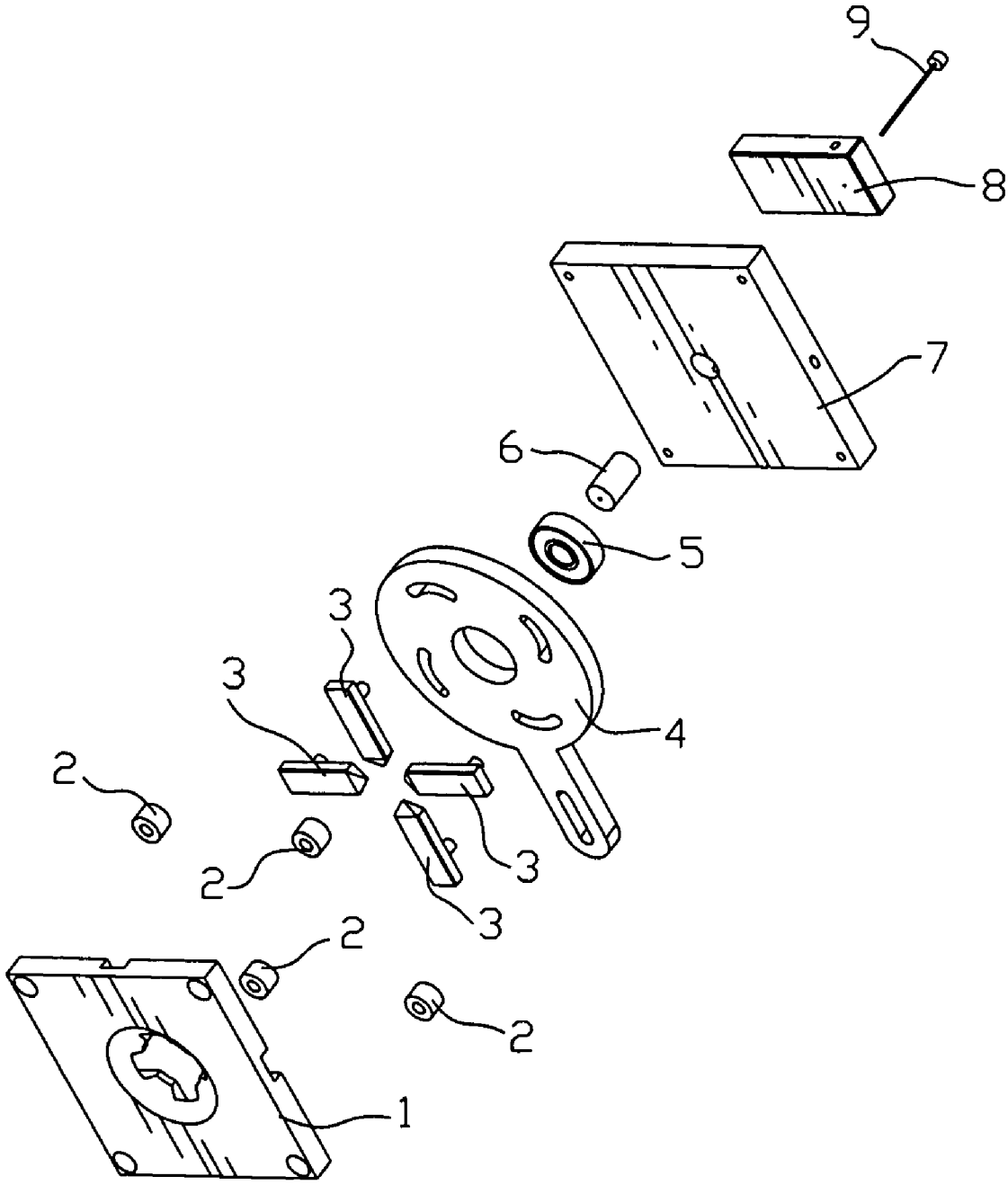
FIG. 3 is an exploded view of a crimping mechanism of the terminal crimping machine.

Referring to FIGS. 1-3, the locating board 22 vertically mounts a basic board 7 and an accommodating board 1 which is parallel with the basic board 7. Four sustaining pillars 2 are settled between the basic board 7 and the accommodating board 1 to fix the basic board 7 and the accommodating board 1 together.

Figure 6:
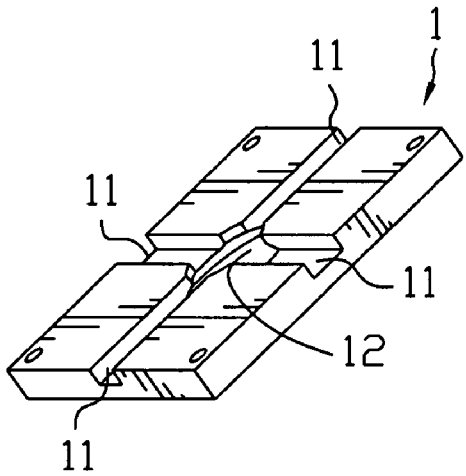
FIG. 6 is a perspective view of an accommodating board.

Referring to FIG. 6, the accommodating board 1 defines four recesses 11 at a back surface thereof. The four recesses 11 unfold symmetrically in left-right direction and up-down direction. The center of the accommodating board 1, that is, the junction of the four recesses 11 defines an aperture 12 running through the accommodating board 1.

Figure 8:
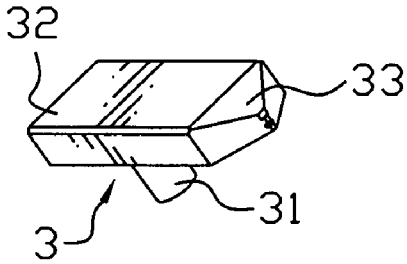
FIG. 8 is a perspective view of a drift.

Referring to FIG. 3, FIG. 6 and FIG. 8, four drifts 3 are respectively configured in the recesses 11 of the accommodating board 1. Each drift 3 includes a main body 32 slidably received in the recess 11 appropriately. A back surface of the main body 32 protrudes rearward to form a bar 31. One end of the main body 32 extends outward and forms a triangle portion 33 that matches other three triangle portions 33 to define a closed square portion received in the aperture 12, but in a non-work status, the main body 32 is adjacent to the outer edge the recess 11, therefore, the four triangle portions 33 are apart from each other to expose the aperture 12.

Figure 7:
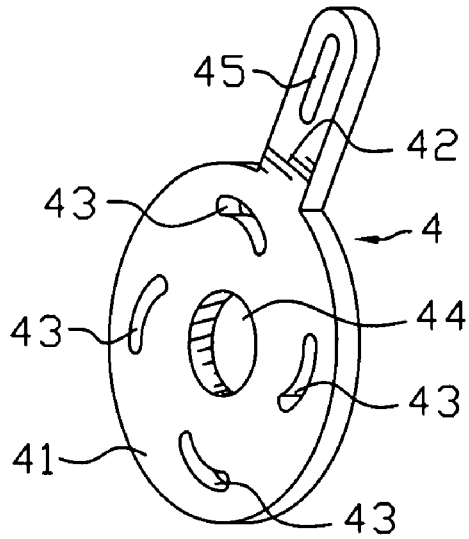
FIG. 7 is a perspective view of a propelled member.

Referring to FIG. 3 and FIG. 7, a propelled member 4 is arranged between the basic board 7 and the accommodating board 1. The propelled member 4 includes a circular tray 41 and a handle 42 extending from the edge of the circular tray 41. The circular tray 41 defines a bearing hole 44 corresponding to the aperture 12 at center. Four cavities 43 are defined on the circular tray 41, around the bearing hole 44. The four cavities 43 are distributed symmetrically and each cavity 43 extends continually from outside to inside of the circular tray 41. The four cavities 43 receive the four bars 31 of the drift 3 respectively. The handle 42 defines a connecting slot 45 passing therethrough.

Figure 9:
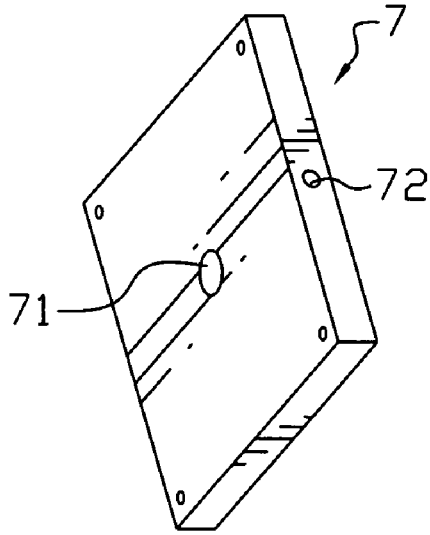
FIG. 9 is a perspective view of a basic board.

Referring to FIG. 3 and FIG. 9, the basic board 7 defines a receiving hole 71 passing therethrough at center. The receiving hole 71 receives a rear end of a positioning element 6. A lateral side of the basic board 7 defines a locking hole 72 with screw threads in an inner surface thereof. The locking hole 72 passes through the receiving hole 71 in order to locate the positioning element 6 in the basic board 7. A front end of the positioning element 6 employs a bearing 5 which is fixed in the bearing hole 44 of the propelled member 4.

Figure 11:
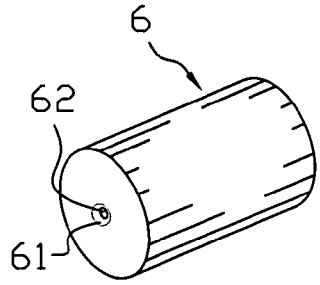
FIG. 11 is a perspective view of a positioning element.
Figure 12:
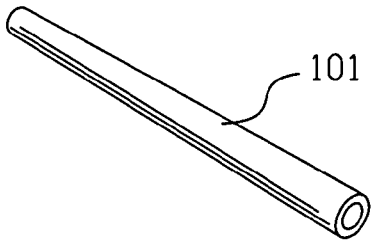
FIG. 12 is perspective view of a terminal.
Figure 13:
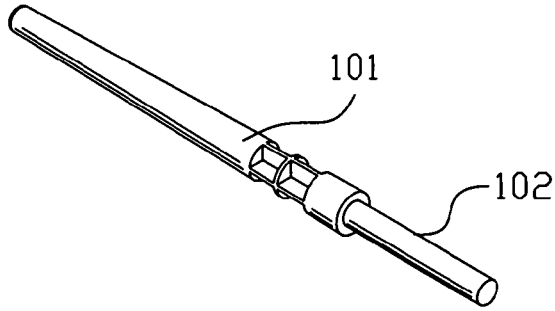
FIG. 13 is a perspective view showing the terminal crimped over an electric cable.

Referring to FIG. 3 and FIG. 11, the positioning element 6 is in a column shape. The axis of the positioning element 6 defines a positioning hole 62 at the front thereof. A bell 61 is defined in the outside of the positioning hole 62, which has the same axis as the positioning hole 62. The rear end of the positioning element 6 is located in the receiving hole 71 of the basic board 7.

Figure 10:
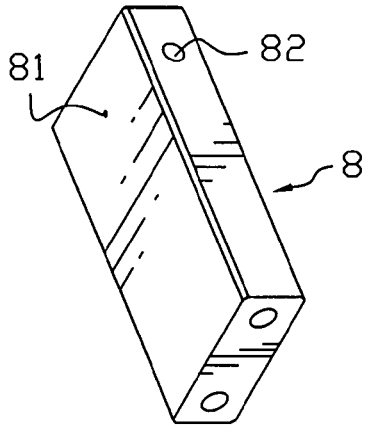
FIG. 10 is a perspective view of an attaching board.

Referring to FIG. 3 and FIG. 10, an attaching board 8 is disposed at the rear of the basic board 7 and on the locating board 22. The attaching board 8 defines a pinhole 81 passing through a front surface and a back surface thereof, and a screw hole 82 communicating with the pinhole 81 at a side thereof. A pin 9 is inserted in the pinhole 81 and further inserted in the positioning hole 62 of the positioning element 6. A screw is employed to fix the pin 9 by inserted in the screw hole 82 (not shown).

Referring to FIGS. 1-3 again, the crimping mechanism includes the accommodating board 1, the four sustaining pillars 2, the four drifts 3, the propelled member 4, the bearing 5, the positioning element 6, the basic board 7, the attaching board 8 and the pin 9. All of these have been described in detailed as above-mentioned.

Figure 5:
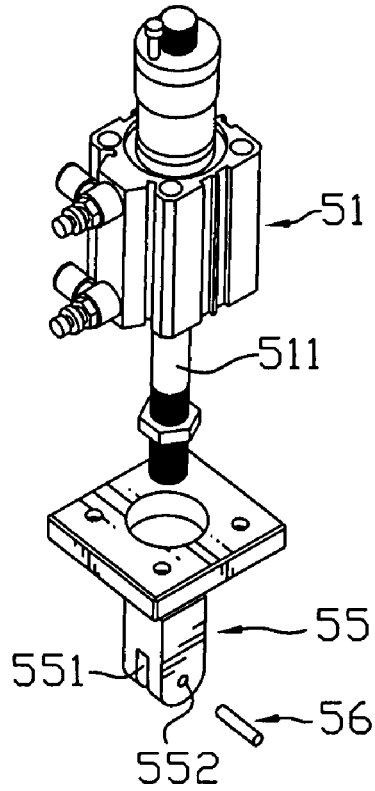
FIG. 5 is an exploded view of a driven mechanism of the terminal crimping machine.

Referring to FIG. 1 and FIG. 5, the driven mechanism includes a cylinder 51 disposed on the loading member 24. The cylinder 51 connects with a pipe 53 to supply air to the cylinder 51. The pipe 53 defines an electromagnetic valve 52 thereon which is connected to a switch 54 for controlling the pipe 53 to supply air to the cylinder 51. The cylinder 51 includes a piston 511 extending downward from a bottom thereof. The end of the piston 511 fixedly connects with a connecting portion 55. The connecting portion 55 defines a connecting groove 551 thereon for receiving the handle 42 of the propelled member 4. A through-hole 552 is defined passing through the connecting groove 551 and the connecting portion 55. A bolt 56 passes through the through-hole 552 and the connecting slot 45 of the handle 42 to locate the handle 42 on the connecting portion 55. The motion direction of the piston 511 forms an angle with the radial direction of the handle 42. In this preferred embodiment, the value of the angle is between 60 degrees and 120 degrees.

Please refer to FIG. 1, FIG. 3, FIG. 12 and FIG. 13. When the terminal crimping machine 100 is in operation, firstly flay the coating of an electric cable 102 which is conventional and includes an electric conductor covered by the coating of thermoplastic insulative material. Then, insert the electric cable 102 into a terminal 101 which is hollow. Afterwards, the terminal 101 is put in the positioning hole 62 of the positioning element 6 from the aperture 12 of the accommodating board 1 until the end of the terminal 101 is against the end of the pin 9. Then, opening the switch 54 and further opening the electromagnetic valve 52, the pipe 53 starts to supply air to the cylinder 51 to drive the piston 511 move up and down. The piston 511 drives the connecting portion 55 move and the connecting portion 55 further drives the propelled member 4 swing through the handle 42 of the propelled member 4, pushing the bars 31 of the drifts 3 which are received in the cavities 43 of the propelled member 4 to move inwardly. The bars 31 bring the main bodies 32 move toward the aperture 12 along the recesses 11 of the accommodating board 1 in order to extrude the terminal 101 receiving the electric cable 102. Then, the electric cable 102 is assembled to the terminal 101 steadily. Finally, the electromagnetic valve 52 controls the airflow direction of air filled in the cylinder 51 to make the piston 511 move oppositely, and then bring the drifts 3 to be in original portions respectively. Then, the assembled terminal 101 is released.

As described above, the driven mechanism can be substituted by an electric machinery with an eccentric wheel.

It can be seen that the design of the terminal crimping machine 100 in accordance with the present invention introduces a propelled member 4 with four curving cavities 43 to match with the drifts 3 which are slidably received in the recesses 11 of the accommodating board 1. Therefore, the force provided by the driven mechanism acts on the drifts 3 from different directions with the help of the propelled member 4. That is, the drifts 3 extrude the terminal 101 receiving the electric cable 102 from different directions, making the terminal 101 fixedly embrace the electric cable 102 and assuring the electrical properties of the terminal 101 and the electric cable 102.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A terminal crimping machine, comprising:

a frame;

an accommodating board, located on the frame and defining recesses unfolding symmetrically, a junction of the recesses defining an aperture running through the accommodating board;

drifts, slidably received in the recesses of the accommodating board respectively, each of the drifts having a bar which protrudes rearward from a back surface of the drift;

a propelled member, rotationally configured at the back of the accommodating board and defining cavities distributing symmetrically, each cavity extending continually from outside to inside, the cavities slidably receiving the bars of the drifts respectively; and a driven mechanism, mounted on the frame and connecting with the propelled member.

2. The terminal crimping machine as claimed in claim 1, wherein the frame fixedly configures a basic board, the propelled member is rotationally arranged between the basic board and the accommodating board, the basic board defines a receiving hole passing therethrough.

3. The terminal crimping machine as claimed in claim 2, wherein the basic board connects with a positioning element which defines a positioning hole in a front surface thereof, a rear end of the positioning element is fixed in the receiving hole of the basic board, a front end of the positioning element employs a bearing to be assembled in a bearing hole defined in the propelled member, the bearing hole corresponding to the aperture.

4. The terminal crimping machine as claimed in claim 3, wherein the frame provides an attaching board at a rear of the basic board, the attaching board defines a pinhole and a screw hole communicating with the pinhole at one side thereof, a pin is inserted in the pinhole and further inserted in the positioning hole of the positioning element, a screw is employed to fix the pin by inserted in the screw hole.

5. The terminal crimping machine as claimed in claim 3, wherein the outside of the positioning hole defines a bell.

6. The terminal crimping machine as claimed in claim 1, wherein the propelled member extends outward to form a handle, the driven mechanism includes a cylinder disposed on the frame, the cylinder includes a piston extending downward from a bottom thereof, the end of the piston fixedly connects with a connecting portion defining a connecting groove thereon for receiving the handle of the propelled member.

7. The terminal crimping machine as claimed in claim 6, wherein the handle defines a connecting slot passing therethrough, the connecting portion defines a through-hole passing through the connecting groove, a bolt passes through the through-hole and the connecting slot to locate the handle on the connecting portion.

8. The terminal crimping machine as claimed in claim 1, wherein the number of the drifts is four, and correspondingly, the accommodating board defines four recesses to receive the drifts respectively, each drift extends outward and forms a triangle portion that matches other three triangle portions to define a closed square portion received in the aperture of the accommodating board.

9. The terminal crimping machine as claimed in claim 1, further comprising sustaining pillars settled between the basic board and the accommodating board to fix the basic board and the accommodating board together.

10. The terminal crimping machine as claimed in claim 1, wherein the frame includes a pedestal in a flat shape, the pedestal engages with a locating board that extends horizontally on a top surface of the pedestal, a backside of the pedestal fixedly fabricates a supporting board vertically, an upper portion of the supporting board defines a pair of receiving slots extending up and down, a loading member is locked on the supporting board through the receiving slots, wherein the accommodating board is mounted on the locating board, and the driven mechanism is disposed on the loading member.

* * * * *